United States Patent [19]

Hashimoto

[11] Patent Number: 4,857,220

[45] Date of Patent: Aug. 15, 1989

[54] BASE OIL OF LUBRICATING OIL FOR MECHANICAL APPARATUSES WITH ORIFICE MECHANISM

[75] Inventor: Katsumi Hashimoto, Ichihara, Japan

[73] Assignee: Idemitsu Kosan Co., Ltd., Tokyo, Japan

[21] Appl. No.: 190,262

[22] Filed: May 2, 1988

[30] Foreign Application Priority Data

May 14, 1987 [JP] Japan ..... 62-115967

[51] Int. Cl.[4] ..... C10M 145/14

[52] U.S. Cl. ..... 252/56 R; 252/32.7 E; 252/45; 252/32.5; 252/33.6; 252/49.6; 252/18; 252/22

[58] Field of Search ..... 252/32.7 E, 56 R, 49.6, 252/33.6, 18, 22, 32.5

[56] References Cited

U.S. PATENT DOCUMENTS 3,869,396 3/1975 Van de Kraats ..... 252/56 R
4,146,492 3/1979 Cusano et al. ..... 252/56 R
4,149,984 4/1979 Wenzel et al. ..... 252/56 R
4,776,967 10/1988 Ichihaski et al. ..... 252/56 R

*Primary Examiner*—Jacqueline V. Howard
*Attorney, Agent, or Firm*—Frishauf, Holtz, Goodman & Woodward

[57] ABSTRACT

A base oil for a lubricating oil and a lubricating oil composition containing said base oil, which are to be used in a mechanical apparatus with an orifice mechanism, are disclosed. The base oil has a kinematic viscosity at 40° C. or 3 to 500 cSt, a pour point of −25° C. or lower and a cloud point of −25° C. or lower. The lubricating oil composition contains as major components (A) the above base oil and (B) at least one additive selected from a viscosity index improver, a pour point depressant, an extreme pressure agent, an anti-wear agent, an oiliness agent and an antioxidant. The base oil and the lubricating oil composition are excellent in working properties at low temperatures and thus can be effectively used in a mechanical apparatus with an orifice mechanism, particularly to be used at low temperatures.

6 Claims, No Drawings

BASE OIL OF LUBRICATING OIL FOR MECHANICAL APPARATUSES WITH ORIFICE MECHANISM

BACKGROUND OF THE INVENTION 1. Field of the Invention

The present invention relates to a base oil for a lubricating oil and a lubricating oil composition containing said base oil, for a mechanical apparatus with an orifice. More particularly, it is concerned with a base oil for a lubricating oil and a lubricating oil composition containing said base oil, which are to be used in various mechanical apparatuses with orifice mechanism and are excellent in working properties at low temperatures.

2. Description of Related Art

In various mechanical apparatuses with orifice mechanism, for example, oil pressure machines such as a shock absorber for automobiles, a door closure and the like, and an automatic feeding apparatus for switching railway points, a lubricating oil the pour point of which is controlled to about −35° C. in view of working properties at low temperatures, by compounding a large amount of a pour point depressant to a base oil having a relatively low pour point (about −15° C.) has heretofore been used.

The above lubricating oil, however, is increased in oil resistance at low temperatures and suffers from various disadvantages. For example, when the lubricating oil is used in a shock absorber, its low temperature damping force (damping capacity) is decreased; when the lubricating oil is used in a door closure, its working properties are reduced; and when the lubricating oil is used in an oil feeding apparatus for switching railway points, an oil cannot be fed at low temperatures. Another disadvantage is that the performance of the lubricating oil markedly varies with a lapse of time, because the polymer (e.g., polymethacrylate) compounded in a large amount as a pour point depressant is subject to mechanical shear.

SUMMARY OF THE INVENTION

The present invention is intended to overcome the aforementioned problems of the prior art lubricating oil to be used in various mechanical apparatuses, and an object of the present invention is to provide a lubricating oil which is improved in working properties at low temperatures and can maintain the performance for a long period of time.

The present invention provides a base oil for a lubricating oil which is to be used in a mechanical apparatus with an orifice mechanism (orifice mechanisms) and which has a kinematic viscosity at 40° C. of 3 to 500 cSt, a pour point of −25° C. or lower, and a cloud point of −25° C. or lower. This invention is hereinafter referred to as the "first invention".

The present invention further provides a lubricating oil composition for a mechanical apparatus with an orifice mechanism, containing (A) the base oil of the first invention and (B) at least one additive selected from a viscosity index improver, a pour point depressant, an extreme pressure agent, an anti-wear agent, an oiliness agent and an antioxidant as main components. This invention is hereinafter referred to as the "second invention".

DESCRIPTION OF PREFERRED EMBODIMENTS

The base oil of the first invention is also used as a base oil for the lubricating oil composition of the second invention. In connection with properties of the base oil, the kinematic viscosity at 40° C. is 3 to 500 cSt and preferably 5 to 300 cSt. If the kinematic viscosity is less than 3 cSt, the base oil is highly inflammable and is of low safety, and further extreme pressure properties and anti-wear properties are undesirably reduced. On the other hand, if it is more than 500 cSt, viscosity resistance becomes too large and various troubles are caused.

The pour point of the base oil is −25° C. or lower and preferably −30° C. or lower. If the pour point is higher than −25° C., low temperature characteristics are poor and it is therefore necessary to add a large amount of a pour point depressant. This will lead to an increase in oil pressure resistance and further to various troubles.

The cloud point of the base oil is −25° C. or lower and preferably −30° C. or lower. If the cloud point is higher than −25° C., a mechanical apparatus with an orifice mechanism, using the resulting base oil may work only insufficiently at low temperatures.

A major feature of the base oil is that the cloud point is −25° C. or lower. Since both the pour point and the cloud point are very low, the base oil effectively functions as a lubricating oil for various apparatuses with orifice mechanism. If the cloud point is higher than −25° C., the base oil causes plugging of an orifice, that is, its working properties are reduced, even if the pour point is −25° C. or lower.

In addition to the aforementioned properties, the base oil is preferred to have a viscosity index of at least 60, with the range of at least 70 being particularly preferred.

As the base oil, various mineral oils or synthetic oils can be used as long as they have the above specified properties.

A preferred example of mineral oils which can be used as the base oil is a deep dewaxed oil obtained by purifying a distillate oil by the usual method, said distillate oil having been obtained by atmospheric distillation of a paraffin base crude oil, an intermediate base crude oil or a naphthene base crude oil, or by vacuum distillation of a residual oil resulting from the above atmospheric distillation, and further by subjecting the above purified distillate oil to deep dewaxing treatment. A method for purification of the distillate oil is not critical; various methods can be employed for the distillate oil purification. Usually, (a) hydrogenation, (b) dewaxing (solvent dewaxing or hydrogenation dewaxing), (c) solvent extraction, (d) alkali distillation or sulfuric acid treatment, and (e) clay filtration are applied, alone or in combination with one another in a suitable order. It is also effective to apply the same treatment repeatedly at a plurality of stages. For example, (1) a method in which a distillate oil is hydrogenated, or after hydrogenation, is further subjected to alkali distillation or sulfuric acid treatment, (2) a method in which a distillate oil is hydrogenated and then is subjected to dewaxing treatment, (3) a method in which a distillate oil is subjected to solvent extraction and then to hydrogenation, and (4) a method in which a distillate oil is subjected to two or three-stage hydrogenation treatment, or after the hydrogenation treatment, is further subjected to alkali distillation or sulfuric acid treatment can be employed.

As the base oil of the present invention, a deep dewaxed oil obtained by subjecting the above obtained purified oil to dewaxing treatment is suitable to use. This dewaxing treatment is called "deep dewaxing treatment", which is achieved by the solvent dewaxing method under severe conditions or the catalytic hydrogenation dewaxing method using a Zeolite catalyst.

In addition to the aforementioned mineral oils, synthetic oils such as alkylbenzene, polybutene, poly(α-olefin) and mixtures thereof can be used as the base oil of the present invention.

A lubricating oil containing the above base oil alone as a main component is sufficiently improved in working properties at low temperatures and thus can be used effectively in mechanical apparatuses with orifice mechanism.

The lubricating oil composition of the second invention comprises (A) the base oil of the first invention and (B) at least one additive selected from a viscosity index improver, a pour point depressant, an extreme pressure agent, an anti-wear agent, an oiliness agent and an antioxidant.

Examples of the viscosity index improver and/or the pour point depressant include polymethacrylate, polyisobutylene, α-olefin polymers, α-olefin copolymers (e.g., an ethylene-propylene copolymer), polyalkylstyrene, phenol condensates, naphthalene condensates, a styrenebutadiene copolymer and the like. Of these, polymethacrylate having a number average molecular weight of 10,000 to 300,000, and α-olefin polymers or α-olefin copolymers having a number average molecular weight of 1,000 to 30,000, particularly ethylene-α-olefin copolymers having a number average molecular weight of 1,000 to 10,000 are preferred.

The extreme pressure agent, the anti-wear agent, the oiliness agent and the antioxidant to be used in the present invention are not critical; various compounds conventionally known can be used in the present invention.

As the extreme pressure agent, sulfur-based extreme pressure agents, such as sulfides, sulfoxides, sulfones, thiophosphinates, thiocarbonates, sulfurized fats and oils, sulfurized olefins and the like; phosphorus-based extreme pressure agents, such as phosphoric acid esters (e.g., tricresyl phosphate (TCP) and the like), phosphorous acid esters, phosphoric acid ester amine salts, phosphorous acid ester amine salts, and the like; halogen-based extreme pressure agents, such as chlorinated hydrocarbons and the like; organometallic extreme pressure agents, such as thiophosphoric acid salts (e.g., zinc dithiophosphate (ZnDTP) and the like) and thiocarbamic acid salts; and the like can be used.

As the anti-wear agent, organomolybdenum compounds such as molybdenum dithiophosphate (MoDTP), molybdenum dithiocarbamate (MoDTC) and the like; organoboric compounds such as alkylmercaptyl borate and the like; solid lubricant anti-wear agents such as graphite, molybdenum disulfide, antimony sulfide, boron compounds, polytetrafluoroethylene and the like; and the like can be used.

As the oiliness agent (friction modifier), higher fatty acids such as oleic acid, stearic acid and the like; higher alcohols such as oleyl alcohol and the like; amines; esters; fats and oils; sulfurized oils; chlorinated oils; and the like can be used.

As the antioxidant, phenol-based compounds, amine-based compounds, sulfur-based compounds, phosphorus-based compounds and the like can be used.

The amount of the component (B) compounded in the lubricating oil composition of the second invention varies with the properties of the base oil as the component (A), the type of the additive and the like, and cannot be determined unconditionally. In general, the amount of the component (B) compounded may be smaller than in the conventional lubricating oil compositions. More specifically, the amount of the component (B) compounded is chosen within the range of 0.01 to 30% by weight, preferably 0.1 to 20% by weight based on the total weight of the lubricating oil composition.

In the lubricating oil composition of the second invention, one or more of the viscosity index improver, the pour point depressant, the extreme pressure agent, the anti-wear agent, the oiliness agent and the antioxidant are used as the component (B). It is particularly preferred that ($b_1$) the viscosity index improver and/or the pour point depressant be used in combination with ($b_2$) at least one selected from the extreme pressure agent, the anti-wear agent, the oiliness agent and the antioxidant. In this case, the amount of the additives compounded are determined appropriately. Usually, the amount of the component ($b_1$) is 0.01 to 30% by weight, preferably 0.1 to 20% by weight based on the total weight of the composition, and the amount of the component ($b_2$) compounded is 0.01 to 20% by weight, preferably 0.1 to 10% by weight based on the total weight of the composition.

To the base oil for a lubricating oil of the first invention and the lubricating oil composition of the second invention, if necessary, suitable amounts of a corrosion inhibitor, a rust inhibitor, a detergent dispersant, a defoaming agent and the like can be added.

The base oil or lubricating oil composition of the present invention is, as described above, good in working properties at low temperatures. For example, when the base oil or lubricating oil composition is used in a shock absorber, the damping effect is markedly high, and further the effect is maintained stably for a long period of time. Furthermore, the effect is obtained sufficiently without addition of polymers such as polymethacrylate, an ethylene-α-olefin copolymer and the like, or by addition of only a small amount of such a polymer even if it is used. Thus the base oil or lubricating oil composition is excellent in shear stability and can be used for a long period of time.

Accordingly the base oil for a lubricating oil or lubricating oil composition of the present invention can be effectively used in various mechanical apparatuses with orifice mechanism, for example, an oil pressure machine such as shock absorber for automobiles, a door closure and the like, and an automatic oil feeding apparatus for switching railway points, particularly in mechanical apparatuses to be used at low temperatures.

The present invention is described in greater detail with reference to the following examples.

EXAMPLE 1

A lubricating oil composition was prepared by compounding, all based on the total weight of the composition, 0.5% by weight of zinc dithiophosphate (ZnDTP), 0.5% by weight of molybdenum dithiophosphate (MoDTP) and 0.5% by weight of tricresyl phosphate (TCP) to a base oil (kinematic viscosity at 40° C.: 10 cSt; pour point: −42.5° C.; cloud point: −45° C.; viscosity index: 80) obtained by subjecting a distillate oil from an intermediate base crude oil to two-stage hydrogenation and further to deep dewaxing treatment (hydrogenation dewaxing using a Zeolite catalyst).

The lubricating oil composition thus prepared was filled in a shock absorber for automobiles (cylindrical shock absorber; rod: 20 mm (diameter)×400 mm (length); outer cylinder: 43 mm (diameter)×400 mm (length); inner cylinder: 30 mm (diameter)×350 mm (length)) was allowed to stand for a predetermined time at a temperature of −30° C. At the end of the time, the outer cylinder was moved upward and downward under the conditions that the speed was 0.1 m/sec and the stroke was ±30 mm, and the operation load (impact force to start the damping action) of the shock absorber was measured.

The outer cylinder of the shock absorber was vibrated 1,000,000 times by the use of a vibrator under the conditions that the temperature was 15° C., the speed was 1 m/sec and the stroke was ±30 mm to apply a shear stress to the lubricating oil composition. Then, the operation load of the shock absorber was measured under the same conditions as above.

The results of measurement of the operation load of the shock absorber before and after the vibration are shown in the table.

EXAMPLE 2

To the lubricating oil composition prepared in Example 1 was further added 5% by weight based on the total weight of the resulting composition of polymethacrylate (number average molecular weight: 60,000) as the viscosity index improver and/or the pour point depressant to obtain a lubricating oil composition having a kinematic viscosity at 40° C. of 15 cSt, a pour point of −45° C. or lower and a cloud point of −45° C.

The lubricating oil composition thus obtained was measured for the operation load of the shock absorber before and after the vibration in the same manner as in Example 1.

The results are shown in the table.

EXAMPLE 3

To the lubricating oil composition prepared in Example 1 was compounded 10% by weight based on the total weight of the resulting composition of an ethylene-α-olefin copolymer (number average molecular weight: 3,600) as a viscosity index improver to obtain a lubricating oil composition having a kinematic viscosity at 40° C. of 15 cSt, a pour point of −45° C., and a cloud point of −45° C.

The lubricating oil composition thus obtained was measured for the operation load of the shock absorber before and after the vibration in the same manner as in Example 1.

The results are shown in the table.

EXAMPLE 4

The same lubricating oil composition as in Example 1 except that as the base oil, a base oil (kinematic viscosity at 40° C.: 10 cSt; pour point: −35° C.; cloud point: −33° C.; viscosity index: 82) obtained by hydrogenating a distillate oil from an intermediate base crude oil and then subjecting the hydrogenated oil to deep dewaxing treatment (hydrogenation dewaxing) was used, was measured for the operation load of the shock absorber before and after the vibration in the same manner as in Example 1.

The results are shown in the table.

COMPARATIVE EXAMPLE 1

The same lubricating oil composition as in Example 1 except that as the base oil, a base oil (kinematic viscosity at 40° C.: 10 cSt; pour point: −17.5° C.; cloud point: −10° C.; viscosity index: 90) obtained by subjecting a distillate oil from an intermediate base crude oil to solvent extraction treatment was used, was measured for the operation load of the shock absorber before and after the vibration in the same manner as in Example 1.

The results are shown in the table.

COMPARATIVE EXAMPLE 2

The same lubricating oil composition as in Example 1 except that as the base oil, a base oil (kinematic viscosity at 40° C.: 10 cSt; pour point: −35° C.; cloud point: −20° C.; viscosity index: 50) obtained by subjecting a distillate oil from a naphthene base crude oil to solvent extraction treatment was used, was measured for the operation load of the shock absorber before and after the vibration in the same manner as in Example 1.

The results are shown in the table.

COMPARATIVE EXAMPLE 3

To the lubricating oil composition prepared in Comparative Example 1 was compounded 5% by weight based on the total weight of the resulting composition of polymethacrylate (number average molecular weight: 60,000) as a viscosity index improver and/or a pour point depressant to obtain a lubricating oil composition having a kinematic viscosity at 40° C. of 15 cSt, a pour point of −35° C. and a cloud point of −10° C.

The lubricating oil composition thus obtained was measured for the operation load of the shock absorber before and after the vibration in the same manner as in Example 1.

The results are shown in the table.

COMPARATIVE EXAMPLE 4

To the lubricating oil composition prepared in Comparative Example 1 was compounded 10% by weight based on the total weight of the resulting composition of an ethylene-α-olefin copolymer (number average molecular weight: 3,600) to obtain a lubricating oil composition having a kinematic viscosity at 40° C. of 15 cSt, a pour point of −20° C. and a cloud point of −10° C.

The lubricating oil composition thus obtained was measured for the operation load of the shock absorber before and after the vibration in the same manner as in Example 1.

The results are shown in the table.

TABLE

| | Operation Load (Before Vibration) (kgf) | | | | Operation Load (After Vibration) (kgf) | | | |
|---|---|---|---|---|---|---|---|---|
| | After 12 hrs | After 24 hrs | After 72 hrs | After 168 hrs | After 12 hrs | After 24 hrs | After 72 hrs | After 168 hrs |
| Example 1 | 47 | 49 | 50 | 50 | 48 | 49 | 50 | 50 |
| Example 2 | 42 | 42 | 43 | 44 | 45 | 45 | 47 | 47 |

TABLE-continued

| | Operation Load (Before Vibration) (kgf) | | | | Operation Load (After Vibration) (kgf) | | | |
|---|---|---|---|---|---|---|---|---|
| | After 12 hrs | After 24 hrs | After 72 hrs | After 168 hrs | After 12 hrs | After 24 hrs | After 72 hrs | After 168 hrs |
| Example 3 | 42 | 43 | 43 | 43 | 42 | 42 | 43 | 43 |
| Example 4 | 50 | 52 | 53 | 53 | 51 | 52 | 53 | 53 |
| Comparative Example 1 | 100< | 100< | 100< | 100< | 100< | 100< | 100< | 100< |
| Comparative Example 2 | 57 | 62 | 67 | 72 | 59 | 63 | 67 | 72 |
| Comparative Example 3 | 45 | 50 | 54 | 60 | 49 | 55 | 59 | 64 |
| Comparative Example 4 | 100< | 100< | 100< | 100< | 100< | 100< | 100< | 100< |

The following can be seen from the results of the table.

(1) When a lubricating oil having a high cloud point is used, the operation load at low temperatures is large (see Comparative Examples 1 and 2, and Example 1).

(2) When polymethacrylate is added to a base oil having a high pour point and a high cloud point to decrease the pour point of the base oil, although the operation load at low temperatures is improved, the good performance cannot be maintained for a long period of time (see Comparative Example 3 and Example 2).

(3) When a base oil having a low pour point and a low cloud point is used, the operation load at low temperatures is small for a long period of time, and its shear stability is sufficiently high (see Examples 1 and 2).

Particularly when an ethylene-α-olefin copolymer is added to the above base oil, the operation load at low temperature is markedly small, the good performance is maintained for a long period of time, and the shear stability is sufficiently high (see Example 3).

What is claimed is:

1. A base oil for a lubricating oil to be used in a mechanical apparatus with an orifice mechanism, having a kinematic viscosity at 40° C. of 3 to 500 cSt, a pour point of −25° C. or lower, and a cloud point of −25° C. or lower.

2. A lubricating oil composition for a mechanical apparatus with an orifice mechanism, comprising:

(A) a base oil having a kinematic viscosity at 40° C. of 3 to 500 cSt, a pour point of −25° C. or lower and a cloud point of −25° C. or lower; and (B) at least one additive selected from a viscosity index improver a pour point depressant, an extreme pressure agent, an anti-wear agent, an oiliness agent and an antioxidant.

3. The composition as claimed in claim 2 wherein the amount of the component (B) compounded is 0.01 to 30% by weight based on the total weight of the composition.

4. The composition as claimed in claim 2 wherein the component (B) is a mixture of ($b_1$) at least one additive selected from a viscosity index improver and a pour point depressant, and ($b_2$) at least one additive selected from an extreme pressure agent, an anti-wear agent, an oiliness agent and an antioxidant.

5. The composition as claimed in claim 2 wherein the viscosity index improver or the pour point depressant is polymethacrylate, an α-olefin polymer or an α-olefin copolymer.

6. The composition as claimed in claim 4 wherein the viscosity index improver or the pour point depressant is polymethacrylate, an α-olefin polymer or an α-olefin copolymer.

* * * * *